United States Patent [19]

Dupre

[11] Patent Number: 5,004,151

[45] Date of Patent: Apr. 2, 1991

[54] METHOD AND APPARATUS FOR MAKING SNOW

[76] Inventor: Herman K. Dupre, c/o Seven Springs, Champion, Pa. 15622

[21] Appl. No.: 438,615

[22] Filed: Nov. 20, 1989

[51] Int. Cl.[5] ..... F25C 3/04

[52] U.S. Cl. ..... 239/2.2; 239/14.2; 239/418; 239/433

[58] Field of Search ..... 239/2.2, 14.2, 418, 239/433

[56] References Cited

U.S. PATENT DOCUMENTS

| | | | |
|---|---|---|---|
| 3,706,414 | 12/1972 | Dupre . | |
| 3,814,319 | 6/1974 | Loomis . | |
| 3,822,825 | 7/1974 | Dupre . | |
| 3,952,949 | 4/1976 | Dupre . | |
| 3,964,682 | 6/1976 | Tropeano et al. | 239/14.2 X |
| 4,199,103 | 4/1980 | Dupre | 239/14.2 |
| 4,593,854 | 6/1986 | Albertsson | 239/14.2 |

*Primary Examiner*—Andres Kashnikow
*Assistant Examiner*—William Grant
*Attorney, Agent, or Firm*—Carothers and Carothers

[57] ABSTRACT

A method and apparatus for making snow by discharging a water spray at high velosity from a first nozzle positioned adjacent the top of a tower into a freezing ambient atmosphere and further discharging a jet stream of air under pressure into the throat of the water spray thereby forming a plume of atomized water. The efficiency and capabilities of snow making are enhanced by further discharging water under pressure into the atmosphere through at least one additional nozzle, positioned adjacent to the first nozzle, in the form of an additional spray which is directed into the plume. The additional nozzle may be above, below or beside the first nozzle and if two or more of the additional nozzles are provided, they may be positioned on the same side or on opposite sides of the first nozzle, and the supply of water delivered to the discharge nozzles need not be regulated for varying subfreezing temperatures. The snow tower is preferably rotatable about a vertical axis and is also preferably bent outwardly at an intermediate portion thereof to position the nozzles further away from the base of the tower to assist in regulated placement of the snow in varying wind conditions.

24 Claims, 3 Drawing Sheets

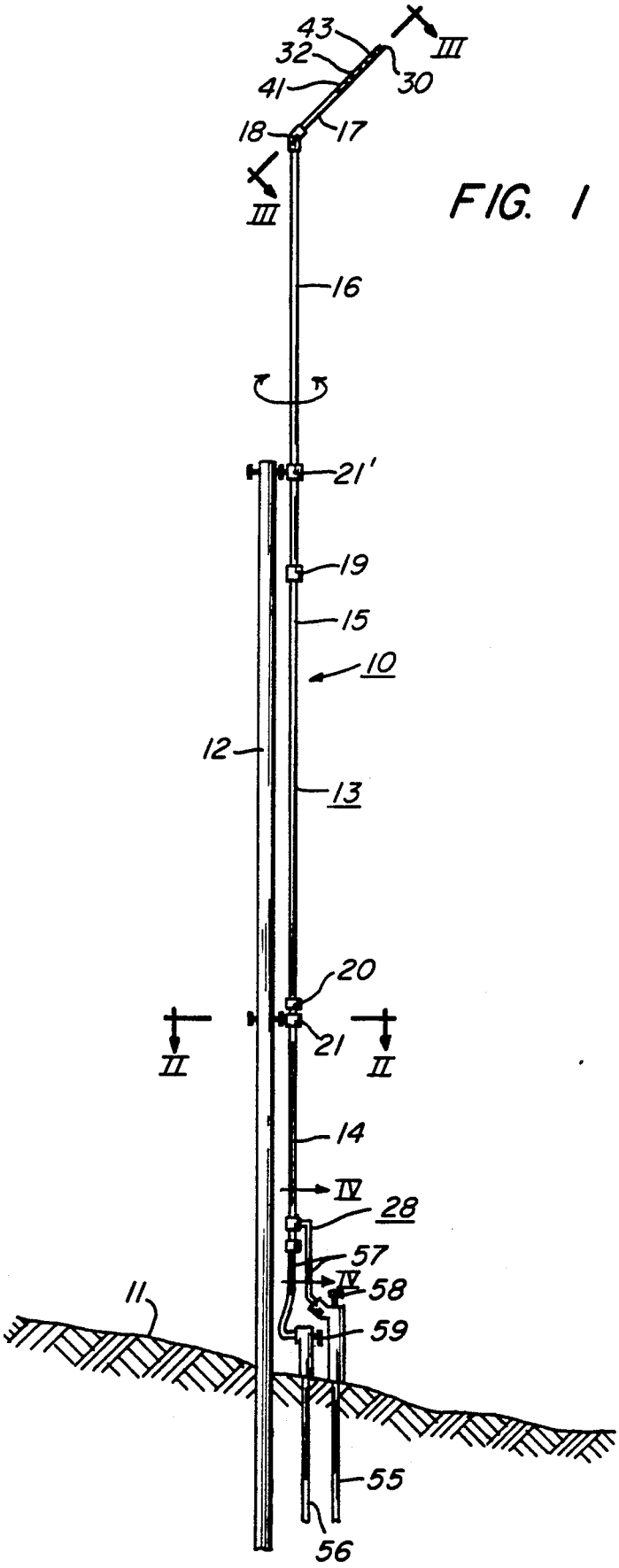
FIG. 1
FIG. 2
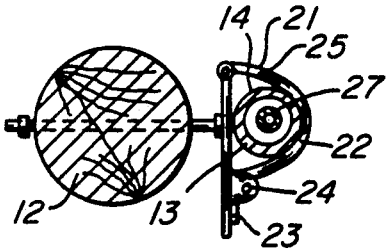

27
14
13
28
52
50
51
53
54

METHOD AND APPARATUS FOR MAKING SNOW

BACKGROUND OF THE INVENTION

The present invention relates generally to the arts of fluid sprinkling and weather control spraying. More particularly, the present invention relates to the art of snow making and an improved method and apparatus for artificially making large volumes of high quality snow suitable for skiing.

The present invention pertains to an improvement over my inventions disclosed in U.S. Pat. No. 3,822,825 issued July 9, 1974 and U.S. Pat. No. 3,952,949 issued Apr. 27, 1976. A suitable discussion giving a major portion the prior art background of the present invention is presented in these patents and is accordingly incorporated herein by reference.

Generally, my former inventions for artificially producing snow as disclosed in these two patent references consist of a method and apparatus for making snow through the use of snow towers wherein water is supplied under pressure to a point of discharge well above ground level and adjacent the top end of the tower where it is discharged through a first nozzle into the ambient freezing atmosphere in a form of a spray. The spray is preferably a high velocity spray of discrete water particles, sometimes referred to as a fine water spray.

Air is supplied independently under pressure to a second point of discharge at the top of the snow tower and there discharged through an orifice to form a jet stream which is directed into the throat of the aforesaid water spray thereby forming a plume of atomized or nucleated water. This atomized water forms seed crystals in the freezing atmosphere, and through the dwell time of the long fall from the top of the tower to the ground, forms snow. My prior method and apparatus for making snow provides excellent quality snow in reasonable quantities and at a reasonable cost. However, it is always desirable to make much larger quantities of excellent quality snow over the same period of time with greater efficiency and lower costs.

In addition to my previous inventions pertaining to snow making towers, some other systems for making snow also merit mention for providing a good background understanding of the art.

One of these other snow making systems can generally be described as a moveable fan blower system and basically consists of a water nucleator spray nozzle positioned in front of a rather large fan which drives the air into a nucleated water spray to produce snow. This unit also carries an air compressor with it and the nucleated water spray is produced internally in a mixing chamber wherein the compressed air and water under pressure are mixed and then discharged through a nozzle. Additional water nozzles are circumferentially positioned about the fan which must be regulated from time to time by turning some or all of them on or off in order to balance the quantity of water which may be supplied under pressure to the quantity of air driven by the fan into the sprayed water for the particular ambient freezing temperature conditions then prevalent. Obviously, with my prior art snow towers and also with such a fan blower system, and most systems for that matter, the amount or quantity of water which may be discharged into the atmosphere in order to continue making quality snow varies inversely with the ambient subfreezing temperature.

In other words, at temperatures only slightly below freezing the water supply has to be reduced in order to prevent the production of wet snow, and as the temperature decreases the water supply discharged into the driven air stream may be increased thereby producing larger quantities of good quality snow at lower freezing temperatures. If too much water is supplied for a given ambient temperature, not only will wet snow be produced but too much water will melt the existing snow accumulation. Accordingly, in warmer ambient freezing or subfreezing temperatures, some of the peripheral water jets of the fan blower type apparatus must be shut off and in my snow making tower system as previously described, no adjustments are required until the temperature rises to about 28 degrees F., and the system is then simply shut off. It is not monetarily or effectively practical to operate any snow making apparatus above this temperature.

This temperature limit of approximately 28 degrees F. is actually variable, depending on the humidity or dew point. This maximum temperature would be 24 degrees F. at 90% humidity or only 22 degrees F. at 100 degrees humidity. These are dry bulb temperatures. Actually this maximum temperature is more accurately defined as approximately 22 degrees F. wet bulb or dew point temperature. Above this no system can practically make snow as it is too costly and snow quality can be greatly affected.

These fan blower snow making apparatus are provided as a mobile unit which may be towed about the ski slope by a vehicle. Of course they are relatively heavy units (600 lbs., more or less) in view of the fact that they not only have a heavy housing with cowling protection but are also provided with a heavy 15 HP motor for driving the fan and with a self contained air compressor, all of which provide moving parts which require maintenance, can freeze up and some parts are prone to rusting. This type of fan blower system can meritorously deliver up to a capacity of approximately 125 gal. of water per minute maximum. However, this maximum water supply can only be effectively and actually used to make snow if the ambient temperature is below 10 degrees F. Unfortunately in ski country, this temperature condition normally occurs only about 20% of the time during the winter ski season. Thus during 80% of the snow making weather, the maximum water expulsion possible for making snow is somewhere between 30 to 80 gal. per minute with an average probably somewhere below 50 gal./min. For example, if this system is operated at an ambient temperature of 28 degrees F. it will be limited to a maximum useable water consumption rate which is probably in the area of 35 gal./min.

To generate snow at a water consumption rate of 50 gal./min. with this fan blower system requires a total work effort of about 35 HP per minute, 15 HP for the fan motor, 15 HP for the water supply and 5 HP for the air compressor. This system is also understandably expensive to manufacture and can retail on todays market for up towards $18,000 per unit, depending upon accessories.

The fan used in this prior art ground unit requires a cage enclosure for safety, which is prone to collect ice thereby reducing efficiency. In addition, since the unit is at ground level, the ground surface distribution of snow is narrow as it is limited to the fan capabilities.

In view of the fact that the water nucleation is created in an internal chamber wherein the water under pressure is mixed with the air under pressure before the nucleated spray is discharged, the maximum useable water pressure for nucleation is limited to the air pressure value since a greater water pressure would cause the water to back down the air supply tube.

Another fan blower system of the prior art is generally comprised of a fan wherein water is centrally ejected from a hollow axle at the face of the fan blade. No additional air supply is utilized. The unit weighs in the vicinity of 300 lbs. and is mounted on top of a support which stands about thirty feet maximum off the ground. Higher supports are not practical in view of the unit weight. These units tend to form ice on fan blades and drip water. Ice flying off the blade can also be a safety hazard. Also many of the disadvantages prevalent with the mobile fan blower units are also applicable to these units. They retail in the area of $12,000. In otherwords, they cannot be realistically mounted at the same level as the top of a conventional snow tower which, prior to my present invention, use to be generally in the area of at least 35 feet. This in and of itself is a disadvantage as I have discovered that when a smaller dwell time is provided from the time the seed crystals are formed to the time that the resultant snow touches the ground, lesser quality snow is produced.

SUMMARY OF THE INVENTION

The principal object of the present invention is to provide an improved snow making method and apparatus which considerably increases the efficiency and the capacity of my former snow making towers.

In my former snow making towers previously discussed, an air jet stream is directed into the throat of the sprayed water emitted from a first or primary water nozzle at the top of the tower and this forms a more or less cone shaped plume of atomized water which produces seed crystals in a freezing ambient atmosphere and ultimately produces snow as the plume falls to the ground during this dwell time which is determined by the height of the tower plus the upwardly projection height of the plume.

I first of all discovered that full utilization of the air discharged under pressure through the orifices at the top of my snow towers was not being realized. Secondly, I further discovered that by discharging additional water under pressure through at least one additional nozzle positioned adjacent to the first nozzle which emits the spray interacting with the air jet stream, such that the additional spray is directed into the aforedescribed plume to interact therewith at the top of the snow tower, that the quantity of excellent quality snow produced could be greatly increased and in fact may be doubled, with the same compressed air consumption. I, and the industry, formerly thought the addition of extra water would undesirably form ice. I further discovered that if the height of the tower above ground is increased, the quality of the snow increases due to the longer dwell time (the period of time from when the seed crystals are formed in the plume in front of the nucleator nozzles to the time that they reach the ground in the form of snow flakes).

The snow making method and apparatus of the present invention can produce snow of exceptionally good quality at a water output of approximately 50 gallons per minute utilizing only 23 horsepower to accomplish this, compared to the 30 horsepower required to operate the stationary support mounted fan blower type snow making apparatus and the 35 horse power required to operate the mobile fan blower type unit in order to produce the same quantity of snow.

In addition, the method and apparatus of the present invention provide even much greater efficiencies over my former method and apparatus as disclosed in U.S. Pat. Nos. 3,822,825 and 3,952,949. My former system could produce snow at a rate utilizing 25 gallons of water per minute with the required use of 40 CFM of air. However, the method and apparatus of the present invention can double the quantity of snow and produce the same excellent quality snow. In other words, the method and apparatus of the present invention can produce snow at a rate of 50 gallons per minute for water consumption while still only consuming 40 CFM of air in favorable subfreezing conditions.

This second discharge nozzle means of my present invention may consist of only one additional nozzle positioned either above or below or beside the original or first discharged water nozzle, or it may consist of a plurality of additional or second water discharge nozzles that are positioned on opposite sides or even on the same side of the original or first water discharge nozzle.

For example, two additional water nozzles may be provided, one above the original first water nozzle and one below. In this particular configuration, the upper most secondary water nozzle will be positioned such that the water spray discharge therefrom is discharged at an angle slightly more, such as 5 degrees to 10 degrees, than the angle at which the water is discharged from the first or original water nozzle relative to the center line of the tower so that the water being discharged from this secondary nozzle will be directed into the aforedescribed plume of atomized water particles to interact therewith. This interaction typically occurs at a distance of approximately four feet from the tower.

In a similar manner, a secondary water nozzle positioned below the original or first water nozzle will be positioned such that the water discharged therefrom is angled slightly closer to the center line of the snow tower water conduit than the angle formed by the water discharged from the original or primary water nozzle so that the water discharged from this secondary nozzle below the original nozzle will be directed into the same foresaid plume formed by the original water nozzle having the air jet stream directed into the throat thereof. More than one air jet orifice and first water nozzle combination, with the additional water nozzle means added on, may be provided at the top of any given snow tower.

The snow tower of the present invention requires no adjustments. The system is simply turned on and when temperatures rise to about 22 degrees F. wet bulb, the system is turned off.

Another principal object of the method and apparatus of the present invention is that the snow tower of the present invention is mounted such that the snow tower can be rotated from the ground to accommodate different and shifting wind conditions so that the nozzles at the top of the snow tower are properly rotated to discharge such that the major portion of the snow produced is discharged with the wind direction and deposited in the desired area on the ground below.

A further object of the method and apparatus of the present invention is to provide the tower of the present invention with an outward bend at an intermediate portion thereof in order to position these nozzles even further away from the base of or support for the tower so that the snow produced thereby falls to the ground at a position away from the base of the support for the snow towers, where most of the skiing activity occurs on the ski slopes.

In addition, it is also another principal object of the present invention to provide a snow tower which is higher than heretofore thought possible in order to position the nozzles at a much greater distance off the ground thereby providing a greater dwell time (as previously defined) and creating better quality snow.

It was previously not thought possible to produce snow at the great quantities which are now capable with the method and apparatus of the present invention at such great heights above the ground surface, due to the heavy and awkward nature of the fan blower type snow making apparatus and due to the limited snow making capacities of the stationary snow making towers of my prior invention.

Due to my discoveries of the present method and apparatus for making snow, it is now possible to make such larger quantities of excellent quality snow at much higher elevations off the ground than ever heretofore thought possible, even with my own prior art snow making towers. This can now be readily accomplished at snow tower heights of 60 feet or greater. The present invention has provided a snow making system that is more energy efficient than any system presently available on the market at any subfreezing temperature. The system of the present invention permits the production of snow of larger quantities at higher elevated levels above the ground and with much greater efficiency and distribution and with less labor over all than any system presently available on the market.

For example, generally one individual can handle ten portable ground gun units for making snow which each, on the average, might typically discharge 20 gallons per minute of water, or 200 gallons per minute total, for production of snow. With the snow making method and apparatus of the present invention, one man can handle the production of snow at a rate of 4,000 gallons per minute and also regulate the towers and orient the same properly.

Accordingly, if an 18,000 gallon per minute water supply capability is available, such as is the case at the Seven Springs Ski Resort at Champion, Pa., only six people would be required to start up and shut down the system of the present invention and only four people would be required to run the system after start-up to produce snow at a water discharge rate of 18,000 gallons per minute. With the conventional ground gun snow making apparatus as previously described, in order to obtain this same 18,000 gallon per minute capacity, it would take approximately ninety people to accomplish the same task.

As another example, with the conventional mobile fan blowers as previously described, five or six of these fan blowers would produce snow at a water discharge rate of approximately 300 gallons per minute. One man could handle these five or six units. However, it would obviously take approximately sixty people utilizing a sufficient number of these mobile fan blowers to obtain the same 18,000 gallon per minute capacity produced by the snow making method and apparatus of the present invention.

Referring again to the stationary fan blowers which are mounted on a short tower or support, these fan blowers would generally normally require four people to operate the required number of tower blowers which could produce 4,000 gallons per minute of discharge water for producing snow. Accordingly, comparing this system to that of the present invention, in order to obtain an 18,000 gallon per minute capability and operate a sufficient number of these tower blowers to do so, one would require twenty people to obtain the same capacity that requires only four people to operate a system of the same capacity of the present invention.

One tower of the present invention can produce snow at a water consumption rate of up to 50 gal./min., even when the temperature is only as low as 28 degrees F., yet still only requires an air consumption of 40 CFM and no adjustments are required. Compared to the fan blower systems, the system of the present invention also provides a better snow distribution, has a greater dwell time, has no internal mixing chamber for mixing water and air, has no fan or other moving parts to freeze or break, will not freeze up or accumulate ice and will not rust. They can be left on the ski slopes for the entire year, year after year.

The retail cot of one tower or station of the snow making method and apparatus of the present invention would be only approximately $4,000.00 due to the relatively simple construction.

BRIEF DESCRIPTION OF THE DRAWINGS

Other objects and advantages appear in the following description and claims.

The accompanying drawings show, for the purpose of exemplification without limiting the invention or the claims thereto, certain practical embodiments illustrating the principals of this invention wherein:

FIG. 1 is a view in side elevation of one snow making tower apparatus of the present invention.

FIG. 2 is an enlarged sectional view of the snow making tower illustrated in FIG. 1 as seen along section line II—II.

DETAILED DESCRIPTION OF THE PREFERRED EMBODIMENT

Figure 3:
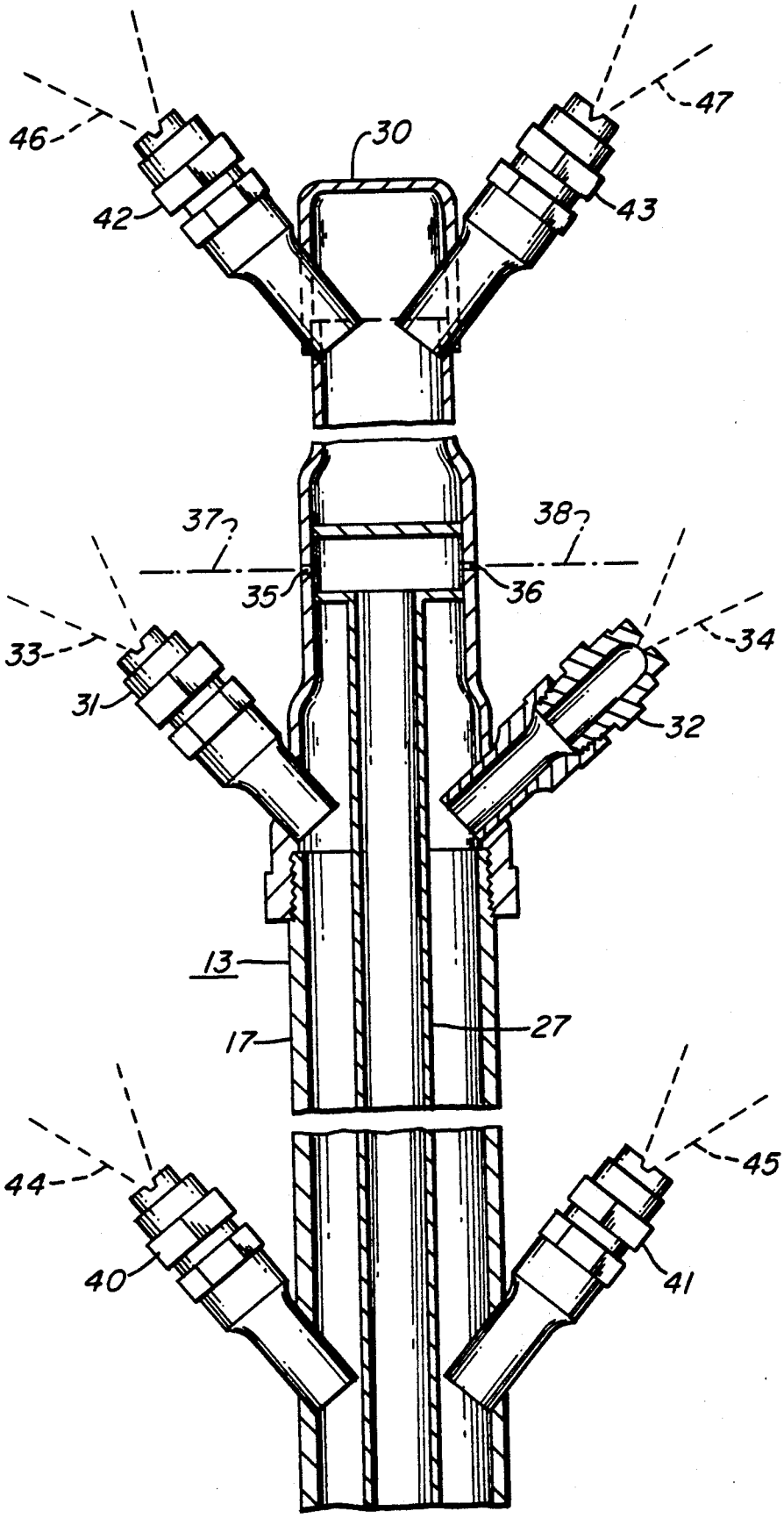
FIG. 3 is an enlarged view in partial section of the upper nozzle end of the snow tower shown in FIG. 1 as seen along section line III—III.

Reference is now made to FIG. 1 wherein there is shown a snow making tower 10 incorporating the method and apparatus of the present invention. This apparatus shown is one of a plurality of snow making towers 10 which are positioned along a ski slope at ground level as indicated at 11 adjacent to a ski trail as illustrated in my U.S. Pat. No. 3,706,414.

The snow making tower 10 consists of support means in the form of a wood pole 12 anchored in the ground 11.

The support 12 supports elongated water conduit 13 which is fabricated out of a good metallic thermally conducting material such as aluminum. Aluminum provides the necessary lightness and strength to permit the tower to exceed heights of 60 feet above the ground when supported from pole 12 and also a good heat conductor. Pole 12 generally extends 42 feet above the ground and 8 feet thereof is buried under the ground, which is typical for electric poles presently obtainable.

Elongated hollow conduit 13 is comprised of four pipe sections 14, 15, 16 and 17. Pipe sections 16 and 17 are ajoined by a forty-five degree aluminum or steel elbow 18, pipe sections 15 and 16 are joined together by aluminum coupling 19 and pipe sections 14 and 15 are joined together by steel coupling 20.

The reason coupling 20 is fabricated of steel instead of aluminum, is that the underside of coupling 20 rests upon support bracket 21, which in turn is through bolted to pole 12 as indicated. This permits the entire elongated conduit 13 to be rotated about its vertical axis in order to position the upper pipe section 17 with its incorporated spray nozzles and air orifices anywhere within a 360 degree pattern about the verticle axis of conduit 13 to compensate for varying wind conditions. Steel coupling 20 will not wear down as readily as would an aluminum coupling when bearing down on the upper surface of support bracket 21. This arrangement is better illustrated in the cross sectional view shown in FIG. 2. This figure better illustrates the construction of steel support bracket 21. Steel coupling 20 is not illustrated in this figure as the section line cuts immediately below coupling 20 in FIG. 1.

Support bracket 21 in this instance merely consists of a hinge wherein a portion of one hinge leaf 22 is bent in the form of a loop to loosely enclose pipe section 14.

When bent hinge leaf 22 is closed and embraces pipe section 14 as illustrated in FIG. 2, the remaining distal end 23 thereof is secured to the other leaf of a hinge bracket 21 by means of a conventional hasp and pin arrangement 24.

Steel coupling 20 rests upon the top surface 25 of hinge leaf 22 to support the entire power conduit 13 for rotation thereon.

When it is desired to dismantle the tower, the bolt or pin in fastening assembly 24 can be readily removed and hinge leaf 22 swung outwardly away from conduit 13 about hinge pivot 26. Upper hinge bracket 21' is constructed in the same manner.

As can be further seen from FIG. 2, there is a coaxial conduit 27 within water conduit 13. Conduit 27 is an air supply conduit that is coaxially secured within and coextends with water conduit 13. Air conduit 27 is also fabricated from aluminum.

Figure 4:
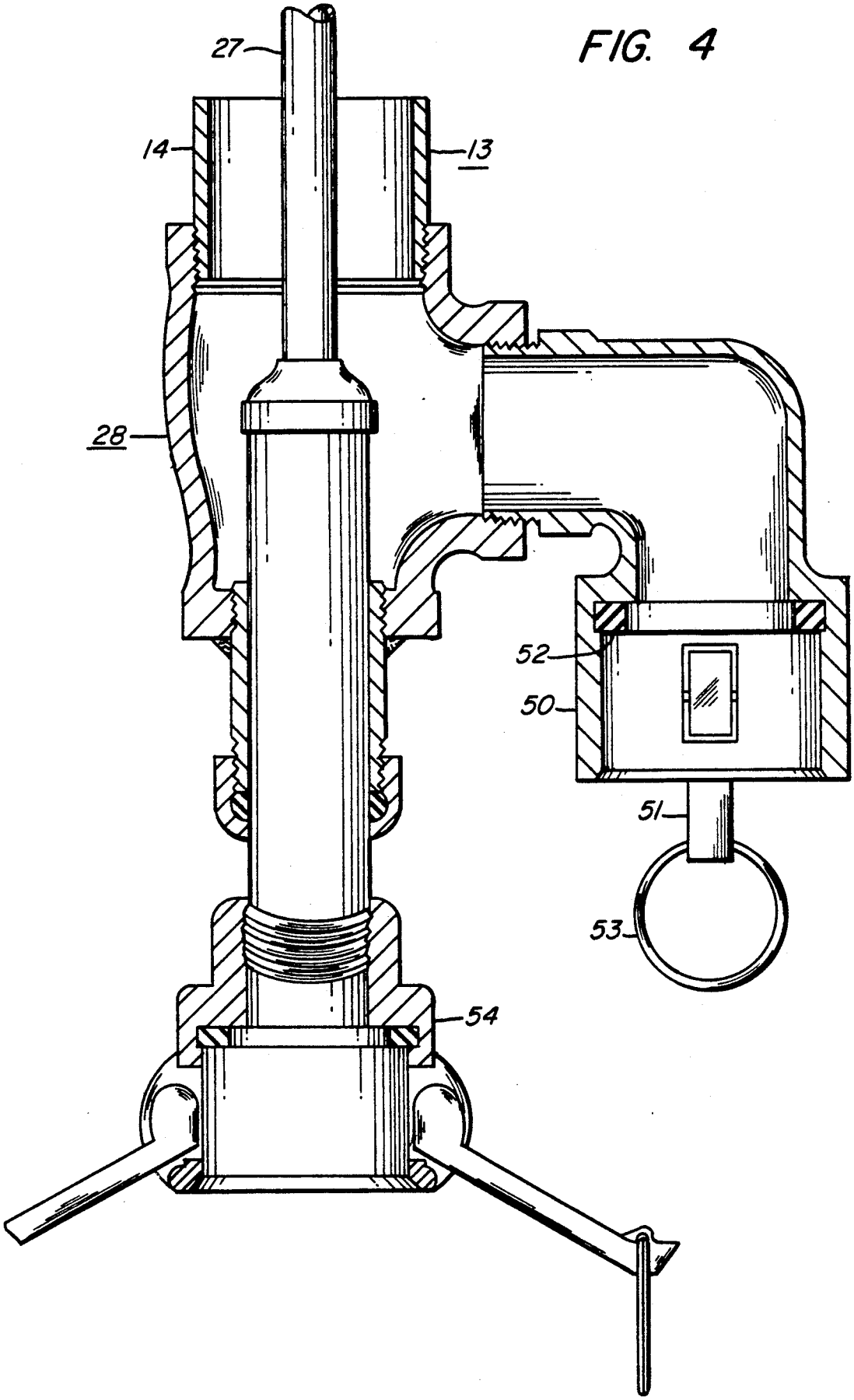
FIG. 4 is an enlarged sectional view of the lower end of the snow making tower shown in FIG. 1 as seen along section line IV—IV.

Water conduit 13 and air conduit 27 are respectively supplied with water under pressure and air under pressure at the bottom ends thereof at lower connector assembly 28, which is illustrated in detail in FIG. 4. The upper most pipe section 17 of water conduit 13 is illustrated in detail in FIG. 3.

Referring to FIG. 1, 2 and 3, with particular reference to FIG. 3, the upper end or section of snow tower 10 is comprised of the upper end or pipe section 17 of water conduit 13 which is capped off at the top thereof by cap 30.

First or primary discharge nozzle means in the form of nozzles 31 and 32 are provided adjacent to the upper end of conduit 13 and water is supplied under pressure within conduit 13 and pipe section 17 such that it coaxially surrounds and moves upperwardly about air conduit 27 and is discharged from nozzles 31 and 32 into the ambient atmosphere in the form of upwardly directed fine water sprays 33 and 34. The water surrounding air conduit 27 prevents it from freezing up, or prevents the moisture within the air contained within conduit 27 from freezing. Air is supplied internally into air conduit 27 at the bottom end thereof, and water under pressure is supplied into conduit 13 at the bottom end thereof, as will be explained in further detail hereinafter with reference to FIG. 4.

Air discharge means in the form of orifices 35 and 36 through the sidewalls of water conduit pipe section 17 are provided to discharge air under pressure therethrough from the interior of air conduit 27 to the ambient atmosphere in the form of air jet streams 37 and 38. These jet streams are respectively discharged into the throat of the high velocity water sprays 33 and 34 to form two large plumes of atomized water and seed crystals in the subfreezing atmosphere in areas well beyond the point of juncture between the air jet streams and the water sprays.

Second or additional discharge nozzle means in the form of second or additional nozzles 40, 41, 42 and 43 are provided, which are basically the same in structure as first nozzles 31 and 32 and are also connected to the same water supply within water conduit 13 or pipe section 17 to provide additional water discharge sprays 44, 45, 46 and 47 respectively. These additional sprays are directed into the aforedescribed plumes formed by the water discharge from nozzles 31 and 32 interacting with the injection of air jet streams 37 and 38.

First or primary nozzles 31 and 32 are angled at 45 degrees from the center line of pipe section 17. However, the acute angle formed between lower secondary nozzles 40 and 41 and the center axis of pipe section 17 is made somewhat less, normally in the area of 35 to 40 degrees so that the respective water sprays 44 and 45 issuing therefrom will be sure to be directed into and interact with the aforedescribed plume formed outward from original or first nozzles 31 and 32.

In a similar manner, secondary or additional water nozzles 42 and 43 are angled outwardly a little more than first nozzles 31 and 32, such that the acute angle that they form respectively with the center line of pipe section 17 is, for example, in the area of 50 to 55 degrees so that the spray issued therefrom will also be directed into the plumes as previously described.

In the figures, the snow tower of the present invention is illustrated with two sets of second or additional nozzles respectively positioned above and below the primary or first set of water nozzles 31 and 32. However, it must be kept in mind that either the upper set or the lower set of secondary nozzles 42 and 43 or the lower set of water nozzles 40 and 41 may be completely eliminated. In a similar manner, lower water discharge nozzles 40 and 41 could also be positioned above air orifices 35 and 36 and angled outwardly so that they have their respective sprays directed into the aforedescribed plumes along with the top set of water discharge nozzles 42 and 43.

Also, the top set of secondary discharge nozzles 42 and 43 could be positioned below the primary or first water discharge nozzles 31 and 32, along with secondly discharge nozzles 40 and 41. In this event, the water nozzles 42 and 43 as repositioned would be angled in a more inward direction so that they too would direct their respective water discharge sprays into the plumes of atomized water and seed crystals.

Furthermore, it is not necessary that the second or additional water nozzles be positioned either above or below the original or first water nozzles 31 and 32. It is also permissible that they be positioned to the side or original water nozzles 31 and 32. For example, they may be positioned at the same level as water nozzles 31 and 32 on pipe section 17 and extend outwardly therefrom and then laterally around at angles of greater than 90 degrees in order to discharge their respective water sprays into the plumes formed by water discharge nozzles 31 and 32 as interacted with the air jet streams discharge from orifices 35 and 36.

Pipe section 17 is angled outwardly at 45 degrees so that the produced snow will not fall too close to the base of the snow tower 10.

The structure of FIG. 3 is merely shown to illustrate what is probably the most economical way to manufacture the structure of the present invention and yet efficiently take advantage of the principals of the present invention.

It should also be kept in mind that all of the nozzle tips provided for both the first water spray nozzles and also for all of the secondary spray nozzles may be changed so that some of the nozzles discharge more water than other nozzles and discharge the water at desired nucleated consistencies in order to achieve the most efficient and effective results.

Referring now to FIG. 4, the detail of lower connector 28 is shown.

Water is supplied under pressure to the interior of conduit 13 by way of the conventional quick release coupling mechanism 50 which utilizes a pair of lever actuated cam arms 51 to engage and hold a water supply hose fitting therein in sealed engagement up against internal annular seal 52. To release the coupling, one merely pulls downwardly on the pull rings 53.

These couplings may be found readily on the market and the same type of coupling 54 is utilized also for the air connection in order to connect the air supply under pressure to the interior of air conduit 27.

The air supply lines used to supply air under pressure to fitting or coupling 54 and the water supply lines used to supply water under pressure to coupling 50 are shown in FIG. 1 and are generally of the same configuration as illustrated in my aforedescribed patents. These water supply and air supply lines 55 and 56 respectively are generally buried below the frost line under the ski slope area in order to prevent freeze-up. Also, it should be noted that since the air couplings 54 are the same as water couplings 50, the flexible canvas type hoses 57 utilized to connect the water and air couplings to the underground water and air lines are identical so that they can be readily interchanged, should any freeze-up conditions begin to occur within the flexible hose supplying air to the bottom end of air conduit 27. Valves 58 and 59 can be shut off for this operation. Hoses 57 and above ground portions of supply pipes 55 and 56 are insulated to prevent internal freezing.

I claim:

1. A method of making snow comprising the steps of:

supplying water under pressure to a first point of discharge above ground;

discharging the supplied water through a first nozzle into the ambient atmosphere in the form of a spray when the atmosphere has a temperature lower than the freezing point of water;

independently supplying air under pressure to a second point of discharge above ground;

discharging the supplied air under pressure into ambient atmosphere in the form of a jet steam directed into the throat of said sprayed water thereby forming a plume of atomized water to produce snow; and discharging the supplied water through at least one additional nozzle positioned adjacent to said first nozzle into the ambient atmosphere in the form of an additional spray directed into said plume.

2. The method of claim 1 including the step of providing two of said additional nozzles positioned on opposite sides of said first nozzle.

3. The method of claim 1 including the step of continually insulating said air supplied to said second point of discharge for at least substantially its entire supply length of exposure above ground by coextensively surrounding the same to said second point of discharge with said water supplied under pressure.

4. The method of claim 3 including the step of positioning said first nozzle at least twenty feet above ground level.

5. The method of claim 4 including the step of horizontally rotating said water spray discharge.

6. The method of claim 3 including the step of supplying said air and said water to said second and first points of discharge, respectively, through heat conducting conduits.

7. Snow making apparatus comprising an elongated hollow conduit mounted in vertical position from support means to form a snow making tower, first discharge nozzle means provided adjacent the upper end of said conduit, a water supply line attached at the lower end of said conduit to supply water therewithin under pressure and discharge the same through said first nozzle means in the form of a spray, an air conduit secured with and coextending with said water conduit, an air supply line attached to the lower end of said air conduit to supply the same with air under pressure, an air discharge orifice at the upper end of said air conduit and positioned adjacent said first discharge nozzle means to discharge air therefrom into the atmosphere in the form of a jet stream, said discharge orifice and said first nozzle means respectively positioned so that the air discharged from said orifice is directed into the throat of the water spray produced by said first nozzle means thereby forming an atomized water plume to produce snow in freezing ambient conditions, second discharge nozzle means positioned adjacent to said first discharge nozzle means and connected to the water supplied within said water conduit to provide at least one additional water spray discharge directed into said plume.

8. The snow making apparatus of claim 7 wherein said second discharge nozzle means consists of at least one water nozzle positioned above or below said first discharge nozzle means.

9. The snow making apparatus of claim 7 wherein said second discharge nozzle means consists of two water nozzles positioned on opposite sides of said first discharge nozzle means.

10. The snow making apparats of claim 9 wherein said water nozzles are positioned respectively above and below said first discharge nozzle means.

11. The snow making apparatus of claim 7 wherein said second discharge nozzle means includes two water nozzles positioned on the same side of said first discharge nozzle means.

12. The snow making apparatus of claim 7 wherein said air conduit coextends within said water conduit, the lower end of said air conduit extending externally of said water conduit for connection to said air supply conduit.

13. The snow making apparatus of claim 12 characterized in that said air orifice consists of an aperture provided within the wall of said water conduit thereby preventing ice build up around the area of the air orifice.

14. The snow making apparatus of claim 12 characterized in that said first nozzle means are positioned angularly relative to the vertical length of said snow making tower to produce a water spray discharge upwardly at an angular degree within the area of 45 degrees from said elongated water conduit, the air discharged from said air orifice directed into the throat of the angularly discharged water spray.

15. The snow making apparatus of claim 12 characterized by a control valve in said water supply line and said air supply line, the majority of the length of said supply lines located below the frost line.

16. The snow making apparatus of claim 12 characterized by said water conduit comprising a metallic heat conducting medium.

17. The snow making apparatus of claim 7 characterized in that said elongated water conduit is mounted on said support means to be rotatable about a vertically extending axis.

18. The snow making apparatus of claim 17 wherein said tower is bent outwardly at an intermediate portion thereof to position said nozzles means further away from the base of the tower.

19. The snow making apparatus of claim 7 characterized in that the length of said water conduit is sufficiently long to form a tower at least thirty feet high with said support means.

20. The snow making apparatus of claim 19 characterized in that the length of said tower is at least 50 feet to obtain maximum dwell time for the plume to produce show.

21. A system for making snow comprising a plurality of elongated hollow water conduits mounted in vertical position from support means to form an aligned series of snow making towers positioned along the length of a ski slope, first discharge nozzle means provided adjacent the upper end of each of said water conduits, a water supply line attached to the lower end of each of said water conduits to supply water under pressure within said conduits and discharge the same through said first nozzle means in the form of a spray, an air conduit within and for substantially the full length of each of said water supply conduits, the lower end of each of said air conduits extending externally of their respective water conduits, an air supply line attached to each of said air conduit lower ends to supply air therein under pressure, air orifice means in each of said water conduits adjacent the upper ends thereof and said first nozzle means and connected internally to the respective upper ends of said air conduits, said discharge orifice means and said nozzle means on each of said towers positioned so that the air discharged from said orifice means is directed into the throat of the water spray produced by said first nozzle means thereby forming an atomized water plume to produce snow in freezing ambient conditions, said air conduits from their said lower ends to their said upper ends where they are connected with said orifice means being insulated from ambient freezing conditions by the moving and circulating water in said water conduits thereby preventing freeze-up within said air conduits, second discharge nozzle means positioned adjacent to said first discharge nozzle means on each of said towers and connected to the water supplied within said respective water conduits to provide at least one additional water spray discharge directed into said plume for each of said towers.

22. The system for making snow of claim 21 wherein said towers are at least 50 feet high.

23. In a snow making system, a snow making tower comprising an elongated hollow water conduit mounted in vertical position from ground support means, first discharge nozzle means provided adjacent the upper end of said conduit, means for supplying water under pressure to said water conduit for discharge in the form of an upwardly directed spray from said nozzle means, an air conduit provided within and for substantially the full length of said water conduit, means for supplying air under pressure to the lower end of said air conduit, air discharge means provided at the upper end of said air conduit in said water conduit between the upper end of said water conduit and said discharge nozzle means, said air discharge means and said first discharge nozzle means positioned relative to each other to cause the discharge air to be directed into the throat of the discharged water spray to form a plume of atomized water, and additional discharge nozzle means positioned adjacent said first discharge nozzle means and connected to the water supplied within said water conduit to provide at least one additional water discharge spray which is directed into said plume.

24. The snow making tower of claim 23 wherein said tower is at least 50 feet high.

* * * * *